US006735317B2

(12) United States Patent
Paludan-Mueller

(10) Patent No.: US 6,735,317 B2
(45) Date of Patent: May 11, 2004

(54) HEARING AID, AND A METHOD AND A SIGNAL PROCESSOR FOR PROCESSING A HEARING AID INPUT SIGNAL

(75) Inventor: Carsten Paludan-Mueller, Ballerup (DK)

(73) Assignee: Widex A/S, Vaerloese (DK)

( * ) Notice: Subject to any disclaimer, the term of this patent is extended or adjusted under 35 U.S.C. 154(b) by 112 days.

(21) Appl. No.: 10/115,897

(22) Filed: Apr. 5, 2002

(65) Prior Publication Data

US 2002/0118851 A1 Aug. 29, 2002

Related U.S. Application Data

(63) Continuation-in-part of application No. PCT/DK99/00531, filed on Oct. 7, 1999, now abandoned.

(51) Int. Cl.[7] ..... H04R 25/00
(52) U.S. Cl. ..... 381/317; 381/321
(58) Field of Search ..... 381/23.1, 94.1, 381/94.2, 94.3, 94.7, 312, 317, 318, 320; 704/205, 208, 214, 225, 226, 227, 228

(56) References Cited

U.S. PATENT DOCUMENTS 4,185,168 A * 1/1980 Graupe et al. ..... 381/318
4,204,260 A 5/1980 Nysen
4,628,529 A 12/1986 Borth et al.
4,630,302 A 12/1986 Kryter
4,811,404 A * 3/1989 Vilmur et al. ..... 381/94.3
4,852,175 A 7/1989 Kates
5,550,924 A * 8/1996 Helf et al. ..... 381/94.3
5,687,241 A * 11/1997 Ludvigsen ..... 381/312
5,768,473 A 6/1998 Eatwell et al.
6,591,234 B1 * 7/2003 Chandran et al. ..... 704/225

FOREIGN PATENT DOCUMENTS

| | | |
|---|---|---|
| WO | WO 9827787 | 6/1988 |
| WO | WO 9515668 | 6/1995 |
| WO | WO 9934642 | 7/1999 |

* cited by examiner

*Primary Examiner*—Curtis Kuntz
*Assistant Examiner*—Brian Ensey
(74) *Attorney, Agent, or Firm*—Sughrue Mion, PLLC

(57) ABSTRACT

In a hearing aid signal processor with AGC in at least three processing channels (a, B, C) for different frequency bands and with noise squelching capability to affect the gain control in a t least a lowest frequency band (A) and one intermediate frequency band (B) speech signals components in the intermediate frequency band of an input signal including background noise are intensified by estimation of the content of speech signal components in at least the highest frequency band (C) and modification of the gain adjustment cause by noise squelching in the intermediate frequency band (B) to reduce the noise spending.

7 Claims, 4 Drawing Sheets

HEARING AID, AND A METHOD AND A SIGNAL PROCESSOR FOR PROCESSING A HEARING AID INPUT SIGNAL

RELATED APPLICATION

The present application is a continuation-in-part of PCT/DK99/00531, filed Oct. 7, 1999, now abandoned.

BACKGROUND OF THE INVENTION

1. Field of the Invention

The present invention relates to a method for processing a hearing aid input signal. The invention further relates to a hearing aid and to a signal processor for a hearing aid.

2. The Prior Art

In WO 99/34642 a hearing aid having a signal processor with multiple processing channels is disclosed, in which dynamic automatic gain control is effected by detection of the input sound level and/or the output sound level and adapting the output sound level in response to the detected sound level by controlling the gain in each processing channel towards an actually desired value of the output sound level. The gain control is effected at increases and decreases, respectively, of the input sound level by adjusting the gain towards the desired value with an attack time and a release time, respectively, which in response to the detected sound level are adjusted to a relatively short duration providing fast gain adjustment at high input and/or output sound levels and to a relatively long duration, providing slow gain adjustment, at low input and/or output sound levels.

In a practical implementation of this prior art hearing aid, the dynamic gain control is effected partly on the basis of the instantaneous sound input received by the hearing aid, partly on the basis of a statistical analysis of the sound level within a time window extending 20 to 30 seconds back in time. The actual gain adjustment is calculated by a complex algorithm to determine the actual gain control in each channel and the rate of control.

This dynamic gain control has appeared to offer significant advantages compared to earlier AGC methods for hearing aid gain control. At low sound levels, at which the transfer function provides a compressor characteristic and the reproduced sound is sensitive to pumping or vibrating sound effects at varying gain, the sound will be controlled with long attack and release times, whereas at high sound levels, at which the reproduced sound approaches the clipping or pain threshold, the sound will be controlled with short attack and release times.

This prior art hearing aid has moreover been implemented with an effective noise suppression based on detection of the contents of speech and noise in each processing channel. In the absence of noise, the noise suppression or noise squelching is not effective, whereas at the occurrence of heavy noise in a frequency band the gain adjustment otherwise resulting from the dynamic gain control is modified towards a reduced gain. Thereby, the advantage is obtained that use of the hearing aid in a noisy environment in a relatively long time is made possible without causing unacceptable discomfort to the user.

In general, the use of temporary noise suppression or noise squelching in hearing aids or similar devices has been disclosed in several prior art publications.

U.S. Pat. No. 4,630,302 discloses a method and apparatus for aiding hearing with an automatic gain control unit having a first section for increasing the amplitude of input signal segments below a threshold level and a second section for reducing the amplitude of input signal segments above the threshold level. A noise suppressor unit having a long attack time and a short release time is responsive to the output from the second section of the automatic gain control unit and has a threshold level of operation below the threshold level of the automatic gain control unit to pass speech signals and squelch background noise signals between speech signal segments.

In U.S. Pat. No. 4,852,175 a hearing aid signal processing system is disclosed, in which noise squelching in each of a plurality of frequency bands is effected by estimation of the absolute quantity of noise by monitoring the amplitude distribution of sound events in each band and comparing the absolute quantity of noise in a current frequency band, in which gain is to be adjusted, with the absolute quantity of noise in a next high frequency band, whereby the gain in the current frequency band is reduced, if the noise quantity in this band exceeds the noise quantity in the next high band by more than a predetermined threshold value.

In U.S. Pat. No. 5,768,473 an adaptive speech filter is disclosed, in which frequency components of an information signal from an input signal also containing noise is effected by calculation of the total power in each frequency component, estimating the power of the information signal included therein and calculating a modified gain for each frequency band as a function of the total power, the information signal power estimate and a previous estimate of a noise power, the input frequency component being multiplied by said modified gain to produce an estimate of the power of the frequency component of the information signal and a new noise power estimate being estimated from the previous noise power estimate and the difference between the total power in the frequency component and the estimate of the power of the frequency component of the information signal, regardless of whether there is a pause in the information signal.

In the noise squelching implemented in the prior art hearing aid of WO 99/34642 the statistical noise estimation in each frequency band will result in a relatively slow gain reduction, which in case of input signals containing speech and noise components having comparable sound levels has been observed to reduce the perception and the intelligibility of speech in certain situations, e.g. when the hearing aid is used during car driving.

On this background, it is the object of the invention to provide a signal processing method and a signal processor for a hearing aid, in which the content of speech in an input signal also containing noise is intensified to improve the perception of speech.

SUMMARY OF THE INVENTION

In a first aspect, the invention provides a method for intensification of speech signals components in a hearing aid input signal including background noise, comprising the steps of classifying said input signal into at least three frequency bands comprising at least one high frequency band, a low frequency band and at least one frequency band intermediate said high frequency band and said low frequency band, estimating the level of background noise in said low frequency band and at least one intermediate frequency band and adjusting the gain in said low and said one intermediate frequency band in response to the estimated level of background noise to provide squelching of said background noise, characterized by comprising the steps of estimating the content of speech signal components in said at least one high frequency band and modifying the gain adjustment caused by said background noise estimation in at least said one intermediate frequency band to reduce said squelching of background noise and thereby intensify the content of speech signals components occurring in said one intermediate frequency band.

The invention is based on the recognition of the fact that the observed reduction in speech intelligibility referred to above is caused by the effect of upward spread or masking of noise, by which noise typically occurring in the low frequency band of the signal processing system is spread upwards to the adjacent higher frequency band, which will normally contain frequency components of significant importance for speech perception. In result, noise squelching will be effected not only in the low frequency band having the major content of noise, but also in the next higher intermediate frequency band.

The modification of the gain adjustment in this frequency band on the basis of speech components in at least the highest frequency band, in accordance with the invention, yields an intensification or an enhancement of the speech content in intermediate frequency band, which has been observed to provide significant improvement of speech perception.

Whereas the estimation of noise and speech signal components can be effected by a variety of methods known per se, such as disclosed in WO 99/34642, e.g. FFT analysis or peak detection, it is preferred for the method according to the invention that, following said classification, said input signal is subjected to digital signal processing in each of said frequency bands and said estimations of the quantity of background noise and the content of speech signal components are effected by percentile estimation.

In a second aspect, the invention provides a signal processor for a hearing aid, comprising means for receiving an input signal containing speech signal components in the presence of background noise, means for classification of said input signal into at least three frequency bands comprising at least one high frequency band (C), a low frequency band (A) and at least one frequency band (B) intermediate said high frequency band and said low frequency band, variable gain adjustment means for controlling the gain in each of said frequency bands and means for estimating the level of background noise in said low frequency band and at least one intermediate frequency band and adjusting the gain in said low and said one intermediate frequency bands in response to the estimated level of background noise to provide squelching of said background noise, characterized by comprising means for estimating the content of speech signal components in said at least one high frequency band and for modifying the gain adjustment caused by said background noise estimation in at least said one intermediate frequency band to reduce said squelching of background noise and thereby intensify the content of speech signal components occurring in said one intermediate frequency band.

In a third aspect, the invention provides a hearing aid, comprising means for receiving an input signal, means for classification of said input signal according to frequency into at least three frequency bands, designated a high frequency band (C), a low frequency band (A) and an intermediate frequency band (B) intermediate said high frequency band and said low frequency band, gain adjustment means for controlling the gain in said intermediate frequency band, means for estimating the level of background noise in said low frequency band and said intermediate frequency band, means for setting the gain in said intermediate frequency band to a trial value in response to the estimated level of background noise and adapted to suppress background noise, means for estimating the content of speech signal components in said high frequency band and means for modifying the trial value of gain in said intermediate frequency band in order to enhance the content of speech signal components present in said intermediate frequency band.

Preferred embodiments appear from the dependent claims.

BRIEF DESCRIPTION OF THE DRAWINGS

The invention will now be described in more detail in conjunction with several embodiments and the accompanying drawings, in which.

DESCRIPTION OF THE PREFERRED EMBODIMENTS

Figure 1:
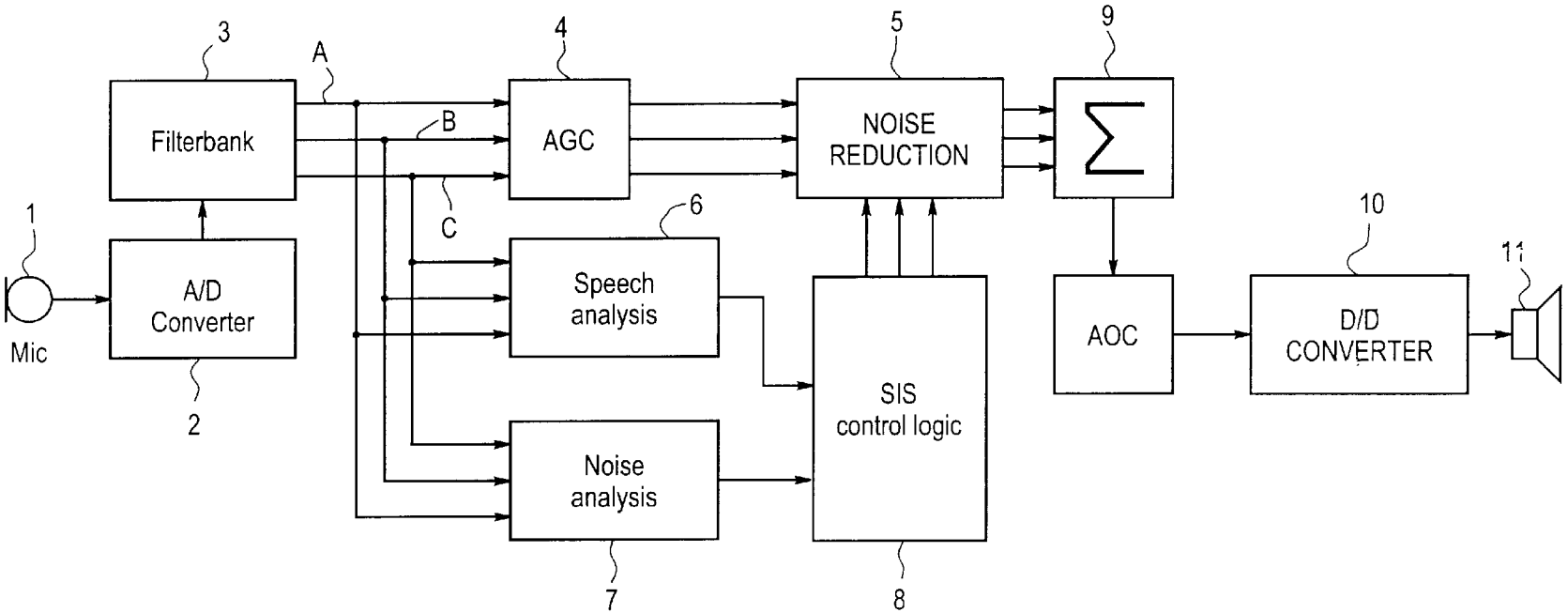
FIG. 1 is an exemplified schematic block diagram of a 3-channel hearing aid signal processor embodying the invention.

FIG. 1 illustrates a 3-channel hearing aid with digital signal processing, in which sound input signals received by a microphone 1 are supplied to an A/D converter 2, the digital output signal of which is supplied to a filter bank 3, by which the digital signals are distributed in three frequency bands comprising a low frequency band, an intermediate frequency band and a high frequency band as denoted by the three output lines A, B and C from filter bank 3.

For each frequency band a separate processing channel A, B and C, respectively, is provided. As shown in the figure, these processing channels A, B and C are mutually similar in structure and each includes a series arrangement of AGC controlled amplification means 4 and a noise reduction or noise squelching block 5.

In each channel, the relevant output signal from the filter bank 3 is supplied in parallel to speech analyzing means 6 and noise analyzing means 7 supplying output signals to a speech intensification or SIS control logic block 8, from which control signals can be supplied to the noise squelching block 5 in the respective processing channel A, B or C.

The digitally processed output signal from each of channels A, B and C is supplied via a summation device 9 and a D/A or D/D converter 10 to an output sound transducer 11, such as a loudspeaker.

Figure 2:
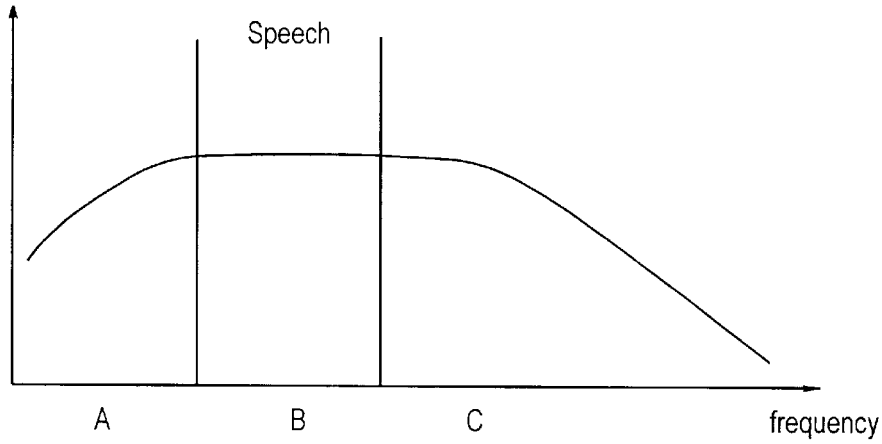
FIGS. 2 and 3 are graphic representations of sound level as a function of frequency for typical speech and noise components of a combined sound input signal received by the signal processor in FIG. 1.

From the graphic representation in FIG. 2 of the amplitude versus frequency relationship for a typical speech signal it can be seen, that a significant part of the sound energy in the speech signal will be located in the intermediate frequency band B, typically ranging from 800 Hz to 2500 Hz, and that also a detectable portion of the sound energy will occur in the high frequency band C.

Figure 3:
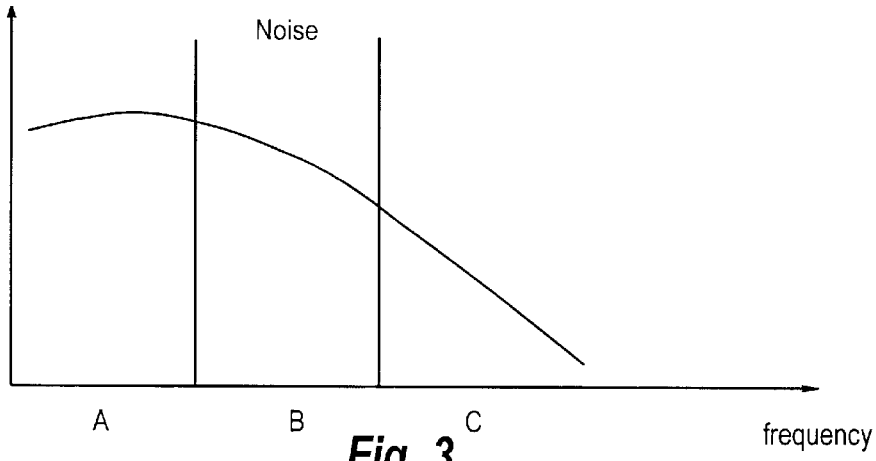

From the graphic representation in FIG. 3 of a typical frequency spectrum for car noise, as perceived by a person inside the car, it can be seen that the dominant part of the sound energy will be present in the lowest frequency band A.

Figure 4:
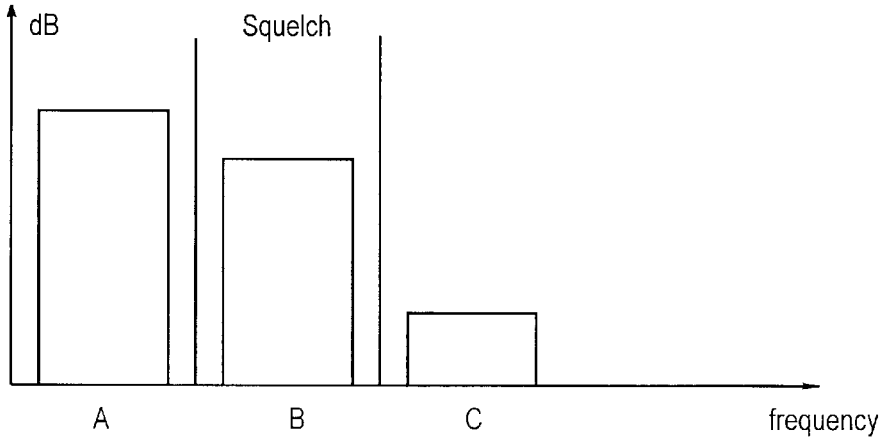
FIG. 4 is a graphic representation of filter damping/attenuation for an input sound signal composed of the speech and noise components as illustrated in FIGS. 2 and 3 by use of conventional noise squelching.

The graphic representation in FIG. 4 illustrates the effect on the normal gain control, e.g. by AGC, of a hearing aid provided with a conventional noise squelching system as explained above and receiving a sound input signal composed of the speech and noise components illustrated in FIGS. 2 and 3. The three columns indicate the increase of filter damping of a gain controlling filter in each of the three processing channels A, B and C caused by noise squelching compared to the damping caused by the normal gain control means of the hearing aid for a sound input signal containing the speech component only, i.e. without any noise component.

As mentioned above, experience has shown that in case of a sound input signal containing speech as well as noise components. e.g. as illustrated in FIGS. 2 and 3, the filter damping will be significantly increased not only in the lowest frequency band, where the dominant part of the noise energy is present, but also in the intermediate band, even if the noise energy in that band in the sound input signal in many situations, like the specific example of car noise, is significantly smaller than in the lowest frequency band. As explained above, this phenomenon is caused by an upwards spread or masking effect from the low frequency band to the intermediate frequency band and results in a significant damping also of speech signal components in this band, whereby the perception of speech in the output sound signal from transducer 11 will decrease significantly for the majority of hearing impaired users.

By means of the method and signal processor of the invention this disadvantage can be substantially reduced. As shown in FIG. 1, each of three processing channels A, B and C, in addition to the noise analyzing means 7 as used per se in known noise squelching systems, comprises speech analyzing means 6 for detection and analyzing of the content of speech in the frequency band supplied to the respective processing channel.

In view of the normal spectral distribution of noise, as illustrated e.g. in FIG. 3, it may strictly spoken only be of advantage to detect and analyze the content of speech in the high frequency band C, but for design reasons all of the processing channels A, B and C, which are normally fully implemented as integrated circuits, preferably have a mutually similar structure.

The output signals from the speech and noise analyzing means 6 and 7 in each of processing channels A, B and C are supplied to SIS control logic block 8, which in response will supply control signals to the noise squelching block 5 in the respective processing channel A, B or C.

The operation can be explained as follows.

For a sound input signal comprising speech without noise, i. e. typically speech in quiet surroundings, neither the noise squelching nor the speech intensification capability of the signal processor will be active and the normal AGC controlled amplification performance of the hearing aid will remain unaffected.

For a sound input signal consisting of noise only, the noise components will be detected and analyzed by noise analyzing means 7, the output signal of which is supplied via SIS control logic 8 directly to the noise squelching block 5 in the processing channel or channels affected by the noise to effect conventional noise squelching as known in the art.

Figure 5:
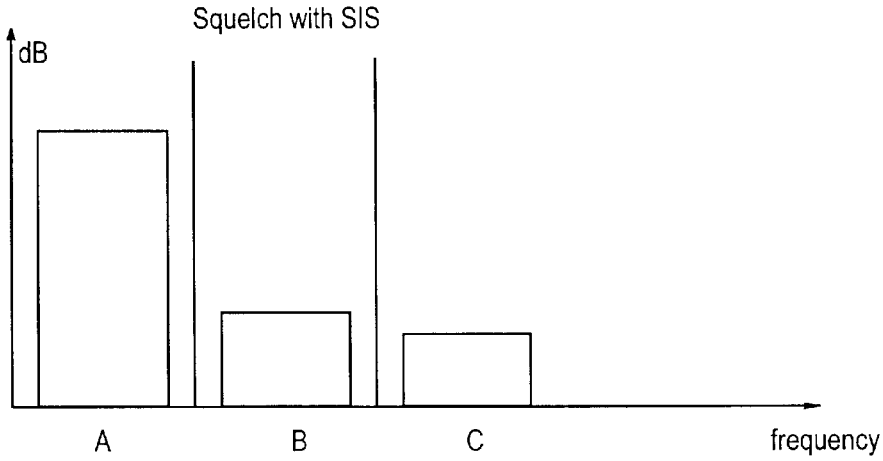
FIG. 5 is a graphic representation of filter damping/attenuation for an input sound signal composed of the speech and noise components as illustrated in FIGS. 2 and 3 by use of speech intensification according to the invention.

In case of a sound input signal comprising speech in the presence of noise as outlined above, the detection of speech in the highest frequency band C will cause a modification of the noise squelching in the intermediate frequency band B. by which, as shown in FIG. 5, the increase of filter damping is lowered compared to conventional noise squelching otherwise resulting from the detection of noise.

Figure 6:
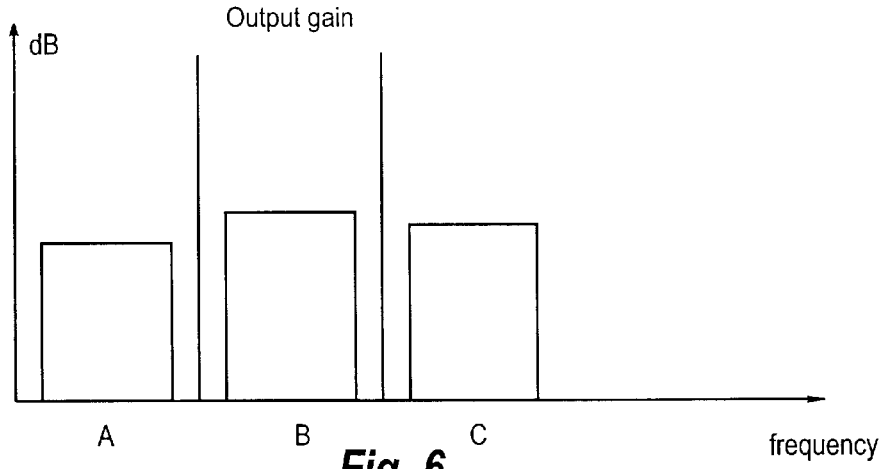
FIG. 6 is a graphic representation of the effect on the output signal level of the AGC and noise squelching illustrated in FIG. 4.
Figure 7:
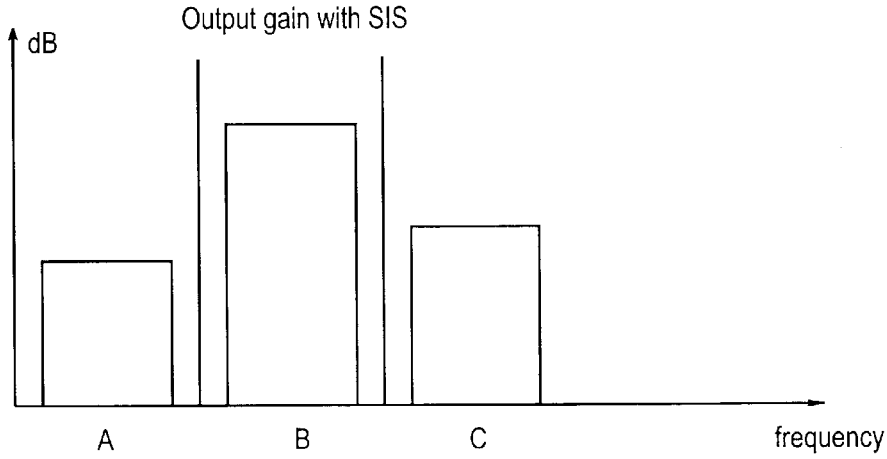
FIG. 7 is a graphic representation of the effect on the output signal level of the AGC and noise squelching illustrated in FIG. 5, and FIGS. 8 to 10 are graphic representations of typical amplitude distributions for speech, noise and a combination of speech and noise.

Whereas FIG. 6 illustrates the effect of conventional noise squelching as illustrated in FIG. 4 on the sound output signal from transducer 11, FIG. 7 shows a significant speech intensification in the intermediate frequency band B.

For a digital hearing signal processor as shown in FIG. 1, the speech and noise analyzing means 6 and 7 are preferably combined and implemented in an integrated structure employing two percentile estimators. Such percentile estimators are known in principle from U.S. Pat. No. 4,204,260 and their use for automatic gain control in hearing aids has been disclosed in WO 95/15668 as well as in WO 99/34642 referenced above, the disclosures of which are incorporated herein by reference.

For the purpose of the noise squelching and speech intensification capability of the method and hearing aid signal processor of the present invention the percentiles of percentile estimators can be adjusted to figures between 5 and 40% and between 60 and 95%, e.g. to 10% and 90%, respectively.

From percentile detectors output signals are supplied to SIS control logic block 8, indicating the amplitude levels forming upper limits for 10% and 90%, respectively, of the input signal analyzed by percentile estimators within a time window of a duration of e.g. 25 seconds.

Figure 8:
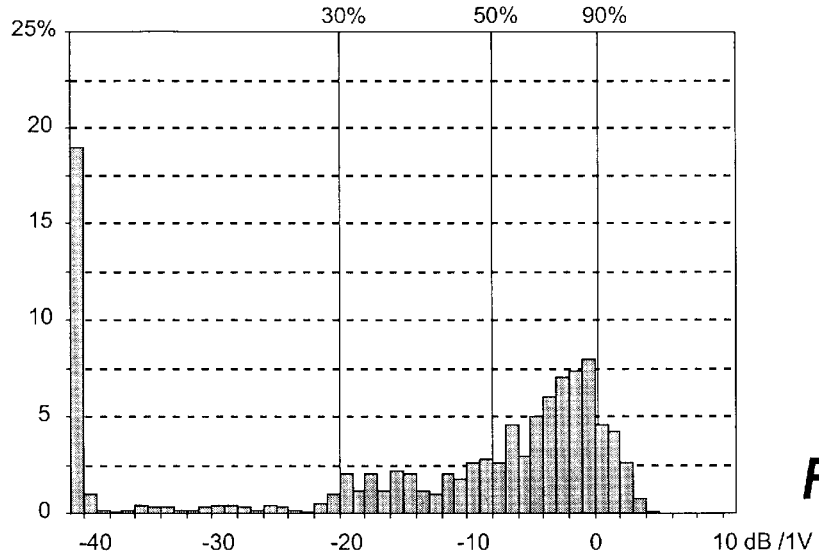
Figure 9:
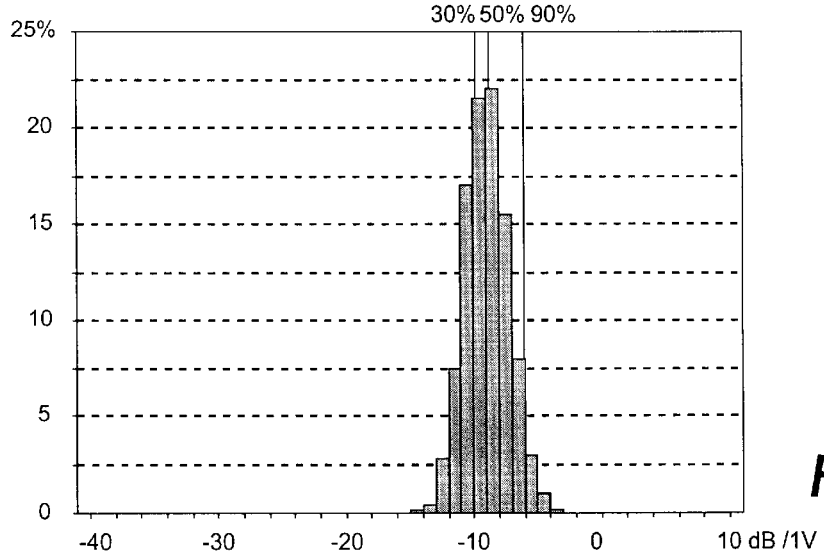

As illustrated in the histogram in FIG. 8, the amplitude distribution of a typical pulse-type speech signal in a quiet environment covers a wide range of amplitude levels corresponding to a relatively large separation of the 10% and 90% percentiles, whereas the amplitude distribution of a typical continuous noise signal will as shown in the histogram in FIG. 9, be confined in a rather narrow range of amplitude levels with much smaller separation of the 10% and 90% percentiles.

Figure 10:
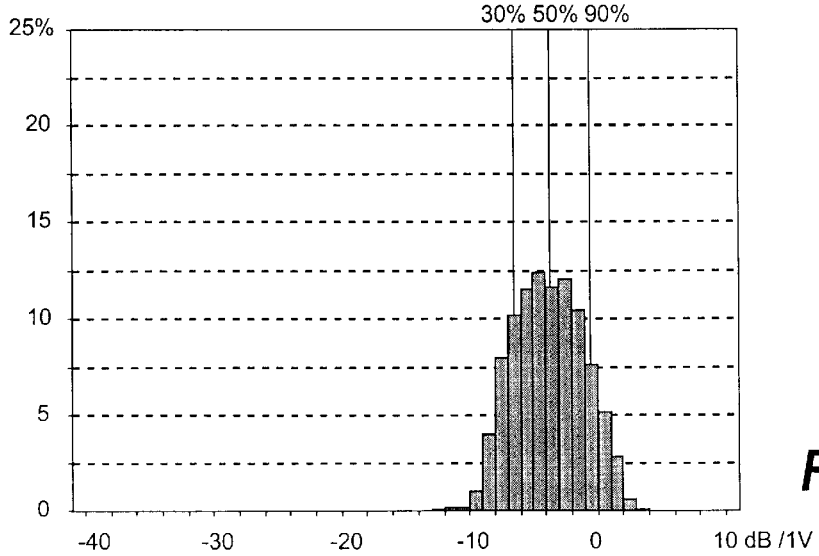

For an input signal containing speech in the presence of noise, the amplitude distribution formed by overlapping of the histograms in FIGS. 8 and 9 will, as shown in the histogram in FIG. 10, form an intermediate between the two extremes of pure speech and pure noise.

This relationship can be used in a simple way by SIS control logic block 8 to effect the control of noise squelching block 5 and provide the speech intensification described above.

Whereas the invention has been explained in the foregoing with reference to a 3-channel hearing aid in which estimation of the content of speech signal components is effected in the highest frequency band, this is not limiting for the invention. In the case, for instance, of multi-channel hearing aids having more than three channels processing signals in a corresponding number of frequency bands, the estimation of speech signal components could be effected with the same advantage in any higher frequency band or combination of bands for which speech signal components dominate over the noise level.

Although particular embodiments of the invention have been described and illustrated herein, it is recognized that modifications and variations may readily occur to those skilled in the art. It is intended that the claims be interpreted to cover such modifications and variations.

I claim:

1. A method for intensification of speech signals components in a hearing aid input signal including background noise, comprising the steps of classifying said input signal into at least three frequency bands comprising at least one high frequency band, a low frequency band and at least one frequency band intermediate said high frequency band and said low frequency band, estimating the level of background noise in said low frequency band and at least one intermediate frequency band and adjusting the gain in said low and said one intermediate frequency band in response to the estimated level of background noise to provide squelching of said background noise, said method further comprising the steps of estimating the content of speech signal components in said at least one high frequency band and modifying the gain adjustment caused by said background noise estimation in at least said one intermediate frequency band to reduce said squelching of background noise and thereby intensify the content of speech signals components occurring in said one intermediate frequency band, wherein said estimations of the level of background noise and the content of speech signal components are effected by percentile estimation.

2. The method according to claim 1, characterized in that following said classification said input signal is subjected to digital signal processing in each of said frequency bands.

3. A method for processing a hearing aid input signal, comprising the steps of:

classifying said input signal according to frequency into at least three frequency bands designated a high frequency band, a low frequency band and an intermediate frequency band intermediate said high frequency band and said low frequency band, estimating the level of background noise in said low frequency band and said intermediate frequency band, selecting a trial value of gain in said intermediate frequency band in response to the estimated level of background noise and adapted to suppress background noise, estimating the content of speech signal components in said high frequency band, and modifying the value of gain in said intermediate frequency band away from said trial value in order to enhance the content of speech signals components present in said intermediate frequency band;

wherein said estimations of the level of background noise and the content of speech signal components are effected by percentile estimation.

4. The method according to claim 3, comprising, following said classification, subjecting said input signal to digital signal processing in each of said frequency bands.

5. A signal processor for a hearing aid, comprising means for receiving an input signal containing speech signal components in the presence of background noise, means for classification of said input signal into at least three frequency bands comprising at least one high frequency band (C), a low frequency band (A) and at least one frequency band (B) intermediate said high frequency band and said low frequency band, variable gain adjustment means for controlling the gain in each of said frequency bands and means for estimating the level of background noise in said low frequency band and at least one intermediate frequency band and adjusting the gain in said low and said one intermediate frequency bands in response to the estimated level of background noise to provide squelching of said background noise, said signal processor further comprising means for estimating the content of speech signal components in said at least one high frequency band and for modifying the gain adjustment caused by said background noise estimation in at least said one intermediate frequency band to reduce said squelching of background noise and thereby intensify the content of speech signal components occurring in said one intermediate frequency band; wherein said means for estimating the level of background noise and means for estimating said speech signal components comprise percentile estimator means.

6. A signal processor for a hearing aid, comprising means for receiving an input signal, means for classification of said input signal according to frequency into at least three frequency bands, designated a high frequency band (C), a low frequency band (A) and an intermediate frequency band (B) intermediate said high frequency band and said low frequency band, gain adjustment means for controlling the gain in at least said intermediate frequency band, means for estimating the level of background noise in said low frequency band and at least one intermediate frequency band, means for setting the gain in said intermediate frequency band to a trial value in response to the estimated level of background noise and adapted to suppress background noise, means for estimating the content of speech signal components in said at least one high frequency band and means for modifying the trial value of gain in said intermediate frequency band in order to enhance the content of speech signal components present in said intermediate frequency band; wherein said means for estimating the level of background noise and said means for estimating the content of speech signals comprises percentile estimator means.

7. A hearing aid, comprising means for receiving an input signal, means for classification of said input signal according to frequency into at least three frequency bands, designated a high frequency band (C), a low frequency band (A) and an intermediate frequency band (B) intermediate said high frequency band and said low frequency band, gain adjustment means for controlling the gain in said intermediate frequency band, means for estimating the level of background noise in said low frequency band and said intermediate frequency band, means for setting the gain in said intermediate frequency band to a trial value in response to the estimated level of background noise and adapted to suppress background noise, means for estimating the content of speech signal components in said high frequency band and means for modifying the trial value of gain in said intermediate frequency band in order to enhance the content of speech signal components present in said intermediate frequency band; wherein said means for estimating the level of background noise and said means for estimating the content of speech signals comprises percentile estimator means.

* * * * *